United States Patent [19]

Rother

[11] 3,959,848

[45] June 1, 1976

[54] VACUUM CLEANER NOZZLE CONSTRUCTION

[75] Inventor: Eberhard Rother, Wuppertal, Germany

[73] Assignee: Vorwerk & Co. Elektrowerke, Wuppertal, Germany

[22] Filed: Jan. 25, 1974

[21] Appl. No.: 436,693

[30] Foreign Application Priority Data

Feb. 8, 1973 Germany ..... 2306101

[52] U.S. Cl. ..... 15/372; 15/28; 15/385; 15/387

[51] Int. Cl.[2] ..... A47L 9/06

[58] Field of Search ..... 15/385, 387, 372, 28

[56] References Cited

UNITED STATES PATENTS

| | | | |
|---|---|---|---|
| 1,538,637 | 5/1925 | Jessen et al. | 15/385 X |
| 1,653,108 | 12/1927 | Koenig | 15/28 X |
| 2,609,555 | 9/1952 | Anderson | 15/385 X |
| 2,703,904 | 3/1955 | DeLong | 15/385 X |
| 3,833,962 | 9/1974 | Krusche | 15/400 |

*Primary Examiner*—Leonard D. Christian
*Assistant Examiner*—C. K. Moore
*Attorney, Agent, or Firm*—Michael J. Striker

[57] ABSTRACT

A housing of a vacuum cleaner nozzle has an opening in which a brush disk is located so that bristles of the disk extend outwardly of the opening. A journal pin for the brush disk extends with one end portion into a tubular socket formed in the housing, and has another end portion engaged by a single-point bearing in the region of the opening. A brush-disk changing arrangement is provided in the region of the socket to facilitate rapid installation and removal of the brush disk in the housing.

6 Claims, 4 Drawing Figures

FIG. 1
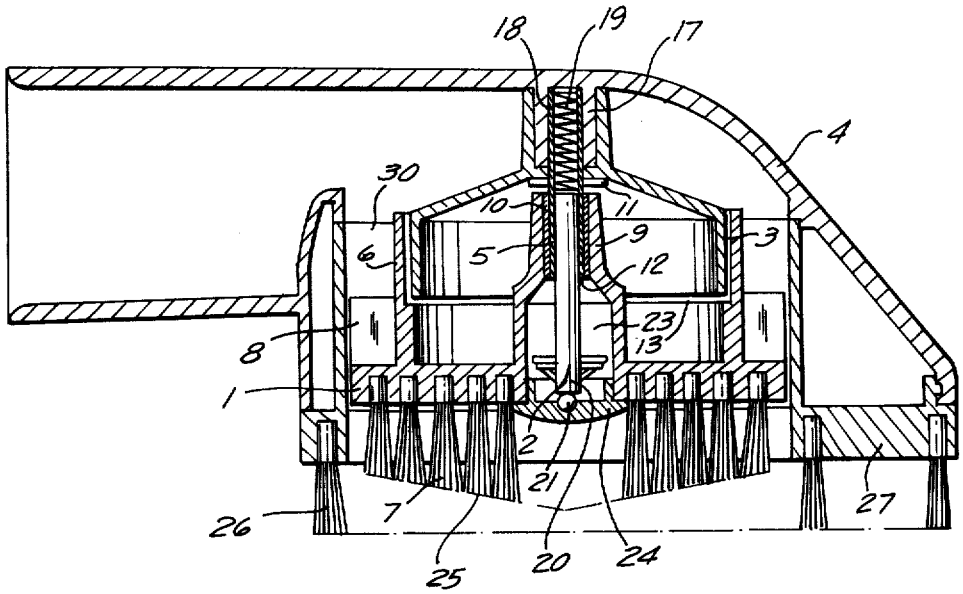
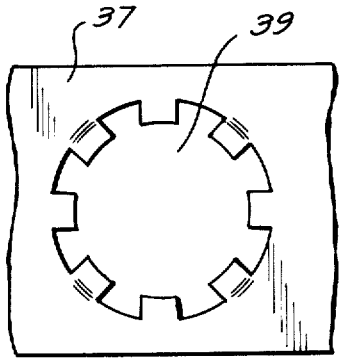
FIG. 4

VACUUM CLEANER NOZZLE CONSTRUCTION

BACKGROUND OF THE INVENTION

The present invention relates generally to a vacuum cleaner, and more particularly to a nozzle unit in a vacuum cleaner construction.

In the prior art there is disclosed a vacuum cleaner nozzle unit which is provided with a rotating disk-shaped brush, having bristles which dislodge dust or contaminants for pick-up by the suction effect of the vacuum cleaner. This construction is highly advantageous in various respects, including the fact that it makes it possible to properly clean a horizontal surface, that it is simple and not subject to malfunction, that it has a rotary brush disk which will always rotate properly and uniformly and can clean even in crevices, recesses, at the base of the nap of a fabric or the like, and wherein the brush is constantly biased into engagement of its bristles with the object to be cleaned.

Moreover, with this arrangement the disk-shaped brush is mounted so that it can be displaced inwardly of the opening of the housing in which it is located, against the action of the biasing spring, which spring of course permanently urges the brush outwardly and into engagement of its bristles with the surface to be cleaned.

It is, however, possible that the rotation of the brush may become prevented in this prior construction by hair, pieces of threads and the like which are aspirated by the suction effect of the vacuum cleaner and which may become so lodged on the brush itself as to prevent its proper rotation, or else they may become lodged on the air guide vanes which are provided on the brush disk and which act in the manner of a turbine. Not only would this clog the inlet of the vacuum cleaner nozzle unit, thereby reducing the suction effectiveness, but it would also slow down or completely stop the rotation of the brush.

SUMMARY OF THE INVENTION

It is, accordingly, an object of the present invention to provide an improved vacuum cleaner nozzle unit which avoids the aforementioned disadvantages.

More particularly, it is an object of the present invention to provide such a unit wherein the brush disk can be readily removed and re-installed, so that in the event any of the aforementioned difficulties occur — such as clogging by deposition of aspirator threads or the like — the brush can be readily removed, the objectionable material taken out and the brush reinstalled.

In keeping with these objects, and with others which will become apparent hereafter, one feature of the invention resides, in a vacuum cleaner, in a nozzle unit which comprises a housing having an opening, and a brush disk located in this opening and having bristles extending outwardly therefrom. Mounting means mounts the disk for rotation about an axis which extends substantially normal to the plane of the opening. This mounting means includes a journal pin extending through the brush disk and having a first and a second end portion, a tubular socket on the housing and turnably accommodating the first end portion, and a single-point bearing journalling the second end portion. There is further provided brush-disk changing means in the region of the tubular socket for facilitating rapid installation and removal of the brush disk in the housing.

The brush-disk changing arrangement according to the present invention is so located that it not only permits a rapid removal and re-installation of the brush disk per se, but is itself protected against the intrusion of dirt and contaminants, so that a blocking of the rotation of the brush disk cannot be occasioned by such an intrusion.

It is now possible, by resorting to the present invention to remove the brush disk from the housing together with all associated components that journal it for rotation, thus making it easy to gain access to any contaminants that have become accumulated and that may have tended to prevent proper rotation of the brush disk, whereupon the latter can be re-installed after the removal of such contaminants. Moreover, all this can be carried out without having to fear damage to any of the functional components.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a vertical section through a construction as disclosed in copending application Ser. No. 403,189;

FIG. 4 is a top-plan view, showing a portion of the leaf spring in FIG. 2, on an enlarged scale.

DESCRIPTION OF THE PREFERRED EMBODIMENTS

Figure 2:
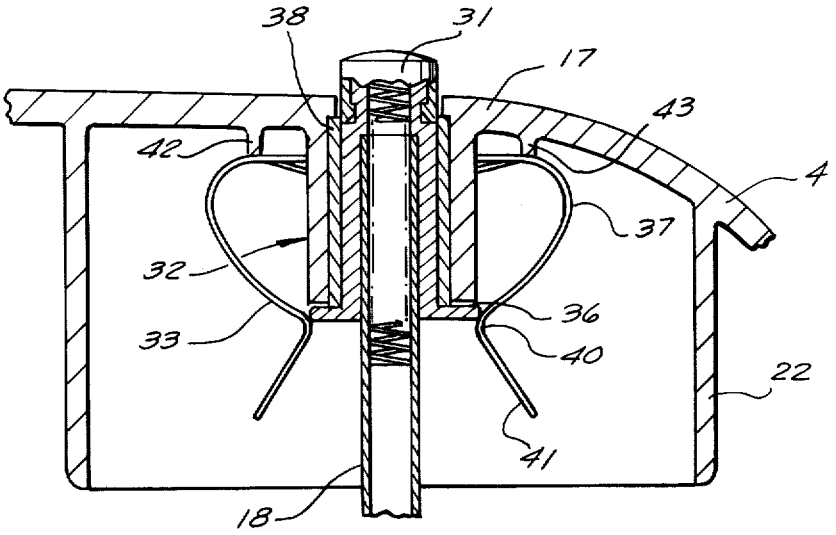
FIG. 2 is a fragmentary vertical section illustrating an embodiment of the present invention.

Referring firstly to FIG. 1, it will be seen that in this prior-art nozzle unit construction for a vacuum cleaner, a brush disk 1 is mounted in a housing 4 having an open side through which the bristles of the brush disk extend. A mounting portion or socket 17 is located in the interior of the housing, being advantageously of one piece with the wall of the housing 4. On the socket 17 is mounted a cupped member 22 of annular configuration, the open side of which faces the opening of the housing 4 in which the brush disk is located. The member 22 is press-fitted on the socket 17, but may be otherwise secured. A tubular guide 18 is also mounted in the socket 17, being press-fitted in the same but of course being capable of being installed in other ways. The tubular guide 18 has two functions, namely to accommodate a biasing spring 19 and to support a metallic sleeve 10 of a central slide bearing 5. The sleeve 10 is in turn accommodated at its lower end in a mounting portion 9 of the brush disk 1. A space 23 is provided within the portion 9 and assures that the brush disk 1 with the bristles 7 thereon can be shifted inwardly and outwardly of the open side of the housing 4 along the axis of rotation which is defined by a journalling pin 2 and extends normal to the plane of the opening of the housing 4. The extent to which the brush disk 1 can be displaced inwardly and outwardly of the open side of the housing 4 is dictated by the length of the space 23 in the direction of the journalling pin 2, and by the location of two abutments constituted by an upper washer 11 and a lower washer 28 both of which are clamped onto the tubular guide 18. A cap 24 is press-fitted into the lower open end of the portion 9 and constitutes a part of the disk 1. A bearing ball 21 engages the inner side of the cap 24 and the axial end face of the pin 2 which faces this inner side, in point contact with both of them. The cap 24 is of course located at the center 14 of the disk 1, and a single-point bearing is thus provided.

The side of the disk 1 which faces inwardly of the housing 4 is provided with an annular collar 6 the open end of which faces inwardly of the housing 4 and is recessed to form a shoulder 13. The length of this recess is slightly greater than the length of the recess 23 in axial direction of the pin 2. The portion provided with the recess forming the shoulder 13 surrounds the cupped portion 22 so that the overlapping parts of these two portions together constitute a sealing means 3 which is effective even though the disk 1 moves upwardly and inwardly with reference to its orientation in the drawing, against the spring action of the spring 19. This assures that the inner components which mount the disk 1 and in particular the slide bearing 5, are protected against dust and the entry of other contaminants, such as thread, hair or the like, which is desired for obvious reasons.

Figure 3:
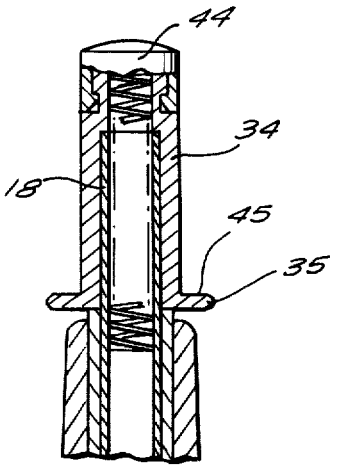
FIG. 3 is a sectioned, fragmentary detail view showing a detail of FIG. 2.

The purpose of the present invention is to further improve the construction of FIG. 1, with an embodiment of the invention being illustrated by way of example in FIGS. 2 – 4.

FIG. 2 shows an enlarged portion of FIG. 1, but provided with the present invention. It will be seen that here the disk 1 itself is not shown, but it will be appreciated that it is mounted by means of the disk-brush changing device 31 which is located within the collar 22. The latter is here of one-piece with the housing 4, but could be otherwise secured to it.

The outer circumferential wall bounding the socket 17 is identified with reference numeral 32 and mounted on it is a leaf spring 37 having the configuration illustrated in FIG. 2. For this purpose a portion of the leaf spring 37 is formed with the opening 39 through which the socket 17 extends and which is bounded by circumferentially alternating teeth that are clearly shown in FIG. 4. These teeth in operation are inclined in axial direction of the socket 17, as shown in FIG. 2. Legs 33 of the spring 37 define with one another a substantially heart-shaped configuration and are formed with bends 40 from which end portions 41 extend as shown in FIG. 1. These end portions 41 thus face away from the socket 17 and the guide tube 18. They serve the purpose of guiding the device 31 and to urge the legs 33 apart when relative movement occurs between the device 31 and the spring 37. Abutments 42 and 43 may be provided on the wall of the housing 4 advantageously of one piece therewith, which are then engaged by the spring 37 when the latter is seated in its proper position, i.e., the position shown in FIG. 2. These abutments may be formed as individual abutments, or as an annulus or the like, and are required to assure that the bends 40 will always be spaced at a predetermined distance from the wall 4 in axial direction of the socket 17, that is they will always be located in a predetermined identical spacing from the end face of the socket 17, so that the flange 35 of the ejecting sleeve 34 will always be urged against the sleeve bearing 38 which extends somewhat beyond the end face 36 at the inner end of the socket 17.

The sleeve 34 is most clearly shown in FIG. 3, and accommodates the guide tube 18 with a press-fit. It is provided with a cap 44 which, as shown in FIG. 1, extends through the wall of the housing 4 (which for this purpose is of course provided with appropriate opening) to be accessible from the exterior.

It will be appreciated that if the brush disk 1 is to be ejected for cleaning, inspection or replacement, it is merely necessary to press upon the cap 44 which is connected with the sleeve 34 by a snap action. This causes the flange 35 to snap past the bends 40 of the spring 37, during axial movement of the sleeve 34 in the socket 17, whereby the brush disk 1 is now freely withdrawable through the open side of the housing 4. After the necessary inspection, cleaning or replacement has taken place, the sleeve 34 is reinserted into the sleeve bearing 38 and a pressure is exerted upon the flange 35 to cause the same to snap past the bends 40 whereby the arms 33 of the spring 37 urge the flange 35 again towards the end face 36 of the socket 17.

The in operation upwardly directed end face 45 of the flange 35 abuts against the sleeve bearing 38 which extends outward beyond the end face 36 of the socket 17, i.e., which extends into the housing 4. That being the case, it is merely necessary to adjust the bends on the spring 37 once during the initial manufacture, to assure that they will always urge the flange 35 to proper position when the brush disk 1 is in the assembled condition shown in FIG. 2.

The leaf spring can be of metallic or synthetic plastic material, and the flange 35 is advantageously of one-piece with the ejecting sleeve 34, as illustrated. To assure that the brush disk 1 will rotate easily, it is further advantageous for the single-point bearing with the guide tube 18 to be rigidly connected with the ejector sleeve 34. The sleeve bearing 38 need not extend beyond the end face 36, but this is advantageous for reasons outlined above.

It will be understood that each of the elements described above, or two or more together, may also find a useful application in other types of constructions differing from the types described above.

While the invention has been illustrated and described as embodied in a vacuum cleaner nozzle unit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. In a vacuum cleaner, a nozzle unit comprising a housing having an opening; a brush disk located in said opening and having bristles extending outwardly therefrom; a tubular socket on said housing; mounting means mounting said disk for rotation about an axis which extends substantially normal to the plane of said opening, including a journal pin extending to said brush disk and having a first end portion rotatably received in said socket and a second end portion, and a bearing ball between and in contact with said second end portion and said disk so as to form a single-point bearing; and brush-disk changing means in the region of said tubular socket for ejecting said mounting means from said socket, thereby disconnecting said disk from said housing and facilitating rapid installation and removal of said brush disk in said housing.

2. In a vacuum cleaner, a nozzle unit comprising a housing have an opening; a brush disk located in said opening and having bristles extending outwardly therefrom; mounting means mounting said disk for rotation about an axis which extends substantially normal to the plane of said opening, including a journal pin extending to said brush disk and having a first and a second end portion, a tubular socket on said housing and turnably accommodating said first end portion, and a bearing ball between and in contact with said second end portion and said disk so as to form a single-point bearing; and brush-disk changing means in the region of said tubular socket for facilitating rapid installation and removal of said brush disk in said housing, comprising a sleeve surrounding said first end portion and accommodated in said socket, said sleeve having a flange juxtaposed with an axial end face of said socket that faces inwardly of said housing, and a leaf spring connected with said socket and having spring portions which engage said flange and urge the same towards said axial end face.

3. A nozzle unit as defined in claim 2, wherein said flange is of one piece with said sleeve.

4. A nozzle unit as defined in claim 2, said mounting means comprising a guide tube surrounding said pin and having a section which is rigidly received within said sleeve.

5. A nozzle unit as defined in claim 4, said tubular socket having a center passage provided with an inner open end and with an outer open end which communicate with the ambient atmosphere.

6. A nozzle unit as defined in claim 2; further comprising a sleeve bearing accommodated in said socket, surrounding said sleeve and extending slightly outwardly beyond said axial end face.

* * * * *